US007749049B2

(12) United States Patent
Hunter et al.

(10) Patent No.: US 7,749,049 B2
(45) Date of Patent: Jul. 6, 2010

(54) SUBMERGED FLUID JET POLISHING

(75) Inventors: John H. Hunter, Almonte (CA); Ian J. Miller, Ottawa (CA); John Nilson, Ottawa (CA); Gregg Senechal, Orleans (CA); Jeff Wimperis, Portland (CA)

(73) Assignee: Lightmachinery Inc., Ottawa (CA)

( * ) Notice: Subject to any disclaimer, the term of this patent is extended or adjusted under 35 U.S.C. 154(b) by 321 days.

(21) Appl. No.: 11/624,805

(22) Filed: Jan. 19, 2007

(65) Prior Publication Data

US 2008/0038991 A1 Feb. 14, 2008

Related U.S. Application Data

(60) Provisional application No. 60/803,161, filed on May 25, 2006.

(51) Int. Cl.
*B24C 1/08* (2006.01)

(52) U.S. Cl. ..... 451/7; 451/113; 451/40

(58) Field of Classification Search ..... 451/38–40, 451/60, 36–37, 42, 104, 113, 7, 2, 3, 41; 901/41; 83/53, 177
See application file for complete search history.

(56) References Cited

U.S. PATENT DOCUMENTS 3,524,367 A * 8/1970 Franz ..... 83/53
5,573,446 A * 11/1996 Dey et al. ..... 451/39
5,591,068 A * 1/1997 Taylor ..... 451/104
5,700,181 A * 12/1997 Hashish et al. ..... 451/40
5,795,212 A * 8/1998 Jacobs et al. ..... 451/36
6,719,611 B2 * 4/2004 Kordonski et al. ..... 451/36
6,955,585 B2 * 10/2005 Mitsuishi et al. ..... 451/5
2006/0019580 A1 * 1/2006 Fahnle et al. ..... 451/36

OTHER PUBLICATIONS

"Fluid Jet Polishing", op Maandag, Sep. 22, 2003 om 10.30 uur, ISBM 90-9017012-X, 2003.

* cited by examiner

*Primary Examiner*—Robert Rose
(74) *Attorney, Agent, or Firm*—Teitelbaum & MacLean; Neil Teitelbaum; Doug MacLean

(57) ABSTRACT

Fluid jet polishing (FJP) is a method of contouring and polishing a surface of a component by aiming a jet of a slurry of working fluid from a nozzle at the component and eroding the surface to create a desired shape. During erosion, the end of the nozzle and the component are submerged within the working fluid, whereby air is not introduced into the closed loop of working fluid slurry. Any bubbles that are present in the system simply bubble to an air pocket at the top of the erosion chamber and are not re-circulated, thereby producing surfaces with very smooth surface finishes.

20 Claims, 2 Drawing Sheets

Closed loop submerged fluid jet polishing

Closed loop conventionalfluid jet polishing

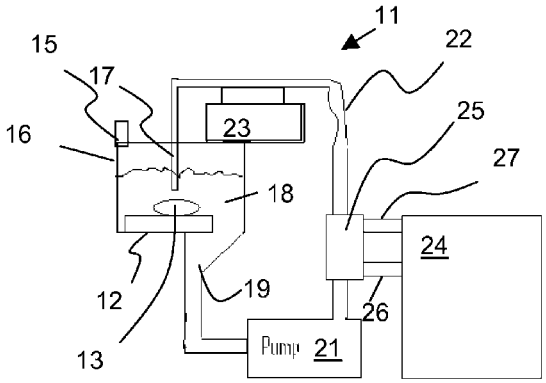
Closed loop submerged fluid jet polishing
Figure 3
Figure 4
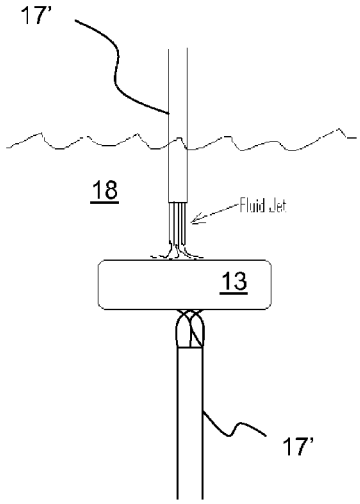

SUBMERGED FLUID JET POLISHING

CROSS-REFERENCE TO RELATED APPLICATIONS

The present invention claims priority from U.S. Patent Application No. 60/803,161 filed May 25, 2006, which is incorporated herein by reference.

TECHNICAL FIELD

The present invention relates to fluid jet polishing, and in particular to fluid jet polishing in a submerged system.

BACKGROUND OF THE INVENTION

Fluid jet polishing (FJP) is a method of contouring and polishing a surface of a component by aiming a jet of a slurry of working fluid at the component and eroding the surface to create a desired shape. Fluid jet polishing has been studied in some detail, in particular by Silvia M. Booij see ISBM 90-9017012-X, 2003.

A conventional fluid jet polishing system 1, illustrated in FIGS. 1 and 2, comprises the following: a part holder 2, which holds a component 3 to be eroded; a contained area 4*a* with a drain 4*b*; a volume of working fluid 5, e.g. water, glycol, oil or other suitable fluids; a pump 6 to pressurize the working fluid 5; and plumbing 7 to return the working fluid 5 to a nozzle 8, which directs the working fluid 5 at the component 3. A motion system 10, usually computer controlled, directs the nozzle 8.

The profile of the effect of a stationary fluid jet on the surface of the component 3 creates a tool pattern. A computer program is then used to optimize the dwell time of the tool pattern on the surface of the component 3 in order to achieve the desired final surface figure. Typically the pressure of the slurry of working fluid 5 remains constant and the velocity (or dwell time) of the nozzle 8 is varied to remove the desired amount of material from different areas of the component 3. Alternatively the nozzle 8 can remain fixed and the component 3 can be moved. A temperature controller may be added to maintain the fluid at a constant temperature.

One of the key challenges with FJP is creating a uniform continuous stream of the working fluid 5. Typically, the working fluid 5 contains small abrasive particles made from hard materials, such as Aluminum Oxide, Diamond and/or Zirconium Oxide in a carrier fluid, e.g. water or similar fluid. The small abrasive particles have a certain negative buoyancy in the working fluid, whereby the impact of the abrasive particles on the surface of the component 3 depends on the speed of the abrasive particles and the buoyancy of the abrasive particles in the working fluid 5. However, air bubbles in the slurry can cause inconsistency in the polishing by dramatically altering the buoyancy of the particles, which causes the particles to damage the surface of the component 3 and increase the surface roughness of the finished surface. The viscosity of air is also much lower than the carrier fluid, so the movement of the abrasive particles to the interface between the working fluid 5 and the surface of the component 3 is faster.

When the jet of working fluid 5 impacts the surface of the component 3, the direction of the flow changes. As the working fluid 5 changes direction, particles suspended therein change direction and experience a force in the direction of the surface. The greater the density difference between the abrasive particles and the working fluid 5, the higher the force toward the surface will be. Centrifugal force drive the particles into the surface and creates the tool profile. The centrifugal force is resisted by the viscosity of the carrier fluid. Smaller abrasive particles have a larger ratio of cross sectional area to mass, which also decreases the ratio of centrifugal force to viscous drag. The response of materials tested to date with the fluid jet process indicates a non-linear response to increasing the centrifugal force/drag ratio. In a Newtonian fluid (viscosity constant with shear, for example water), an abrasive particle density of 7 g/cm$^3$ or more is preferred.

Particle size not only affects the centrifugal force/drag ratio, but also affects the material removal rate. Larger abrasive particles increase the material removal rate, but also increase the finished surface roughness.

Another similar technology, disclosed in U.S. Pat. No. 5,951,369 issued Sep. 14, 1999 to Kordonski et al, is called Magneto Rheological Finishing, (MRF). The technology uses a liquid slurry that is directed to a wheel, where it is stiffened by magnetic fields. The stiff slurry is then carried by the wheel into contact with the component to be finished. After rubbing past the component and causing erosion the slurry is then returned to its liquid state for re-circulation by removal from the magnetic field. The advantage of MRF is that the stiffened slurry provides rapid material removal. The disadvantage is that the magnet and wheel technology makes the process significantly more complex and expensive than fluid jet polishing.

An object of the present invention is to overcome the shortcoming of the prior art by providing a relatively simple, but highly effective fluid jet polishing system providing much smoother and much more accurately figured surfaces than conventional polishing systems.

SUMMARY OF THE INVENTION

Accordingly, the present invention relates to a fluid jet polishing system comprising:

a chamber for enclosing a component during polishing;

a holder for holding the component in the chamber during polishing;

working fluid, including abrasive particles, filling the chamber above a desired level;

a nozzle, having an end disposed below the desired level, for directing a pressurized stream of working fluid at the component; and a motion system providing relative motion between the holder and the nozzle providing a material removal rate from a surface of the component;

wherein the holder and the end of the nozzle are submerged in working fluid, while the stream of working fluid is directed at the component, whereby ambient air is not introduced into the working fluid.

BRIEF DESCRIPTION OF THE DRAWINGS

The invention will be described in greater detail with reference to the accompanying drawings which represent preferred embodiments thereof, wherein:

FIG. 3 is a side view of the fluid jet polishing system according to the present invention; and FIG. 4 is a side view of the nozzle and component of a fluid jet polishing system according to another embodiment of the present invention.

DETAILED DESCRIPTION

Figure 1:
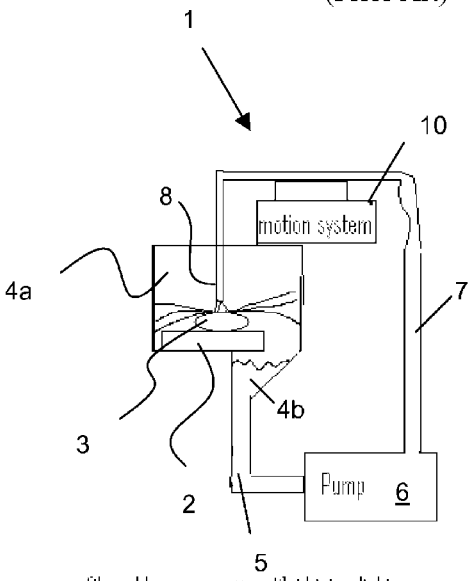
Figure 1 (Prior Art)
FIG. 1 is a side view of a conventional fluid jet polishing system.
Figure 2:
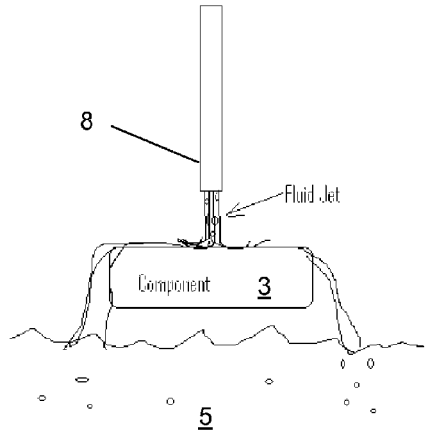
Figure 2 (Prior Art)
FIG. 2 is a side view of the nozzle and component of the fluid jet polishing system of FIG. 1.

With reference to FIGS. 3 and 4, a fluid jet polishing system 11, according to the present invention, includes a part holder 12, which securely holds a component 13 during the erosion process within a contained area of an erosion chamber 16. The part holder 12 can be fixed within the erosion chamber 16, rotatable relative to the erosion chamber 16 or form part of a moveable platform, as will be discussed hereinafter. Rotating the part holder 12 facilitates the production of annular or arcuate profiles. A nozzle 17 directs a pressurized fluid jet stream of a working fluid 18 at a surface of the component 13. The working fluid 5 contains a carrier fluid, e.g. water, glycol, oil or other suitable fluids, and small abrasive particles made from harder materials, such as Aluminum Oxide, Diamond and/or Zirconium Oxide. Varying the type and size of the abrasive particles can be done in order to optimize the surface roughness and/or removal rate. The properties of the working fluid 18 including fluid density, viscosity, pH and rheological properties, can be altered in order to optimize the surface roughness and removal rate, in particular it will be advantageous to have a dilatant fluid in order to increase the removal rate. The viscosity of dilatant fluids increases with increasing shear forces, as compared to normal fluids, in which viscosity is independent of shear forces. Accordingly, when a fluid jet stream including a dilatant fluid impacts on the component 13, the working fluid 5 experiences high shear forces, and therefore has an increase in viscosity, in particular at an interface between the pressurized stream of working fluid 18 and the surface of the component 13. Abrasive particles that normally have very little effect on the component 13, work much better when a dilatant additive, e.g. corn starch or poly vinyl alcohol, is added. Poly vinyl alcohol is a long chain molecule that can be cross linked to form larger molecules, all with varying degrees of dilatant property.

One of the key parameters for selecting good abrasives is density, because very dense particles come out of the working fluid 18, or move to the edge thereof, very quickly and are more aggressive. Air in the working fluid 18 rapidly increases the removal rate, because the decrease in buoyancy and reduction in viscosity resulting from the air causes the abrasive particles to hit the surface of the component 13 very hard; however, particles with low density (high buoyancy) do not come out of the working fluid 18 easily and do not have much affect on the component 13. If suspension agents are added to keep the particles in suspension then the erosion process seems to stop all together. Accordingly, selecting abrasive particles with high density or low buoyancy in the carrier fluid, e.g. water, is important in creating a relatively rapid removal rate. For example, cerium oxide has a specific gravity of 7.8, and zirconium oxide has a specific gravity of 5.8; accordingly abrasive particles with a specific gravity greater than 5 is preferred.

Keeping the dense abrasive particles in suspension in the working fluid 18 is normally difficult and requires stirring or the use of a suspension agent to maintain. Unfortunately, as hereinbefore noted, the suspension agent, by itself, may prevent the abrasive particles from moving to the edge of the flow and doing work. However, the dilatant additive seems to solve this problem by stiffening the fluid and holding the particles quite firmly in the working fluid 18 and greatly increasing the pressure on the component 13. Accordingly, adding both a dilatant additive and a suspension agent to the working fluid 18 is a preferable combination, which eliminates the need for stirring, while providing good removal rates for a wide variety of particle densities. The aqueous suspension agent can be selected from the group consisting of: stearic acid, palmitic acid, myristic acid, lauric acid, coconut oil, palm oil, peanut oil, ethylene glycol, propylene glycol, glycerol, polyethylene glycol aliphatic polyethers, alkyl sulfates, and alkoxylated alkylphenols. The suspension agent can also be an aqueous mixture containing fat and/or fatty acid; a mixture of stearic acid and a vegetable oil; or a material sold under the trademark EVERFLO®, which comprises mostly water, about 12½ wt % stearic acid, about 12½ wt % vegetable oil, and small amounts of methyl paraben and propylene glycol. Other suspension agents may also be used.

Multiple axis (3, 4, 5 or 6) motion systems may be used to process a wide variety of component shapes. A mechanical linkage may also be added to maintain the tool angle over spherical or aspheric component and thereby reduce the need for multi-axis motion control systems During erosion the end of the nozzle 17 and the component 13 are submerged within the working fluid 18, whereby ambient air is not introduced into the closed loop of working fluid slurry. Any air bubbles that are present in the system simply bubble to an air pocket 15 at the top of the erosion chamber 16 and are not re-circulated, thereby producing surfaces with very smooth surface finishes. The air pocket 15 can be vented continuously or at time intervals. A drain pipe 19 at the bottom of the erosion chamber 16 evacuates the erosion chamber 16 and passes the working fluid 18 with eroded particles from the component 13 to a pump 21, which re-pressurizes the working fluid 18. Plumbing pipes 22 are used to return the working fluid 18 back to the nozzle 17.

A motion system 23, which is usually computer controlled, directs the nozzle 17 in the x-y directions or in any suitable directions, e.g. x-y-z-$\theta_z$-$\theta_y$-$\theta_x$, over the component 13 in accordance with the desired pattern and smoothness on the surface of the component 13. Alternatively, in systems in which the nozzle 17 is fixed and the part holder 12 is moveable, the motion system 23 directs the moveable platform of the part holder 12 as desired to obtain the required surface shape and roughness.

A property controller 24, including switch 25 and bypass pipes 26 and 27, may be added to control any one or more of the various properties of the working fluid 18, e.g. temperature, fluid density, viscosity, pH and rheological properties. If temperature control is required, a temperature sensor in the switch 25 determines the temperature of the working fluid 18 and reroutes all or a portion of the working fluid 18 through the property controller 24 via the bypass pipe 26, wherein the temperature of the working fluid 18 is adjusted higher or lower using suitable heating or cooling means. The thermally altered working fluid is passed back to the plumbing 22 via the return bypass pipe 27. The temperature of the working fluid 18 can be adjusted in order to optimize the removal rate of the component particles and/or the surface roughness of the component 13. In particle heating or cooling the tip of the nozzle 17 can affect the properties of the working fluid slurry thereby increasing or decreasing the removal rate, i.e. cooling the working fluid 18 will lead to a stiffer slurry and an increased removal rate. The property controller 24 can alternatively or also include means for altering the pH of the working fluid 18 by adding high or low pH materials thereto for optimizing the removal rate of component material and the surface roughness of the finished product.

Preferably, some means for vibrating or stirring the working fluid 18 is provided within the property controller 24 to maintain the abrasive particles in suspension and to optimize the removal rate and surface roughness. The fluid circulation system should be designed with as few horizontal surfaces as possible to minimize settling of the abrasive particles. Mixing by the normal flow of the working fluid 5 through the nozzle 17 and the pump 21 may be sufficient to keep the abrasive in suspension without additional stirring or vibrating means.

The profile of the effect of a stationary fluid jet on the surface of a component creates a tool pattern in the shape of an annular ring, e.g. a donut, for a vertical nozzle or in the shape of a teardrop for an angled nozzle. A computer program controlling the motion system 23 is used to optimize the dwell time of the tool pattern on the surface of the component 13 in order to achieve the desired final surface shape and smoothness. Typically, the pressure of the fluid jet of working fluid 18 remains constant and the velocity (or dwell time) of the nozzle 17 is varied to remove the desired amount of material from different areas of the component 13. Alternatively, the pressure of the working fluid 18 can be altered or the nozzle 17 can remain fixed and the component 13 can be moved, e.g. reciprocated, using the moveable platform, as hereinbefore discussed. The pressure of the working fluid 18 can be actively changed during the erosion process to provide different removal rates for different portions of the surface of the component 13.

Dwell time calculated for a grid of points distributed over the surface of the optical component 13 can be converted to velocity profile using $v(x,y)=d/T(x,y)$ where $v(x,y)$ is desired velocity between adjacent points and $T(x,y)$ is the calculated dwell time for the second point. Normally, the tool, e.g. nozzle 17, is moved in a raster pattern so the conversion is only applied in one axis.

Preferably, the nozzle 17 is disposed substantially vertically for launching a slurry of working fluid 18 at a constant velocity at the surface of the component 13, traveling back and forth in a simple grid pattern in the x and y directions substantially perpendicular to the surface of the component 13 with the dwell time over each position on the grid determining the amount of material removed. The coordinates of the component 13 are predetermined or determined by the computer system, whereby the computer system can then determine the dwell time at each grid position based on the requirements, i.e. desired characteristics, e.g. dimensions, surface roughness, of the finished product. Sensors in the erosion chamber 16 and/or on the part holder 12 can be used to measuring the properties of the component 13, while the component 13 is being processed in order to create a closed loop system, thereby improving the speed and accuracy thereof.

To provide added control over the erosion process, the orifice of the nozzle 17 can be provided with an adjustable opening or a plurality of nozzles 17, each with different sized openings, can be provided. To increase the removal rate, the size of the orifice is increased or a nozzle 17 with a larger orifice is used. To increase the resolution of the removal, the size of the orifice is reduced or a nozzle 17 with a smaller opening is used. Alternatively, the shape or angle of the nozzle 17 can be changed or altered to create various tool profiles, e.g. disposing the nozzle 17 at an acute angle from vertical creates a tear drop shaped profile. Multiple nozzles 17 can also be provided to increase the speed of particle removal. The distance of the nozzle 17 from the component 13 can be adjusted between runs or actively during each run in order to optimize the resolution, removal rate of particulate material and surface roughness of the component 13. Masks can be provided to prevent the working fluid 18 from contacting certain areas of the component 13 to thereby create deep channels and concave areas. Air, or some other suitable gas for decreasing buoyancy, can be introduced into the working fluid 18 proximate the nozzle 17 or any other suitable location to increase removal rate or affect the surface roughness of the finished product.

With reference to FIG. 4, material can be removed simultaneously from different sides of the component 13, by using one or more nozzles 17' directed at opposite or different sides of the component 13 at the same time. Independent re-circulating systems can be used for each of the nozzles 17' to enable the characteristics, e.g. temperature, pH etc, of the working fluids 18 to be independently adjusted. Alternatively, a single re-circulating system can be used for all of the nozzles 17'.

We claim:

1. A method of fluid jet polishing a component comprising:
a) enclosing the component in a chamber;
b) holding the component in a holder in the chamber;
c) filling the chamber with a working fluid, including abrasive particles, above a desired level;
d) disposing an end of a nozzle below the desired level, wherein the component and the end of the nozzle are submerged in the working fluid, whereby ambient air is not introduced into the working fluid;
e) directing a pressurized stream of the working fluid from the nozzle at the component;
f) increasing the viscosity of the working fluid at an interface between the pressurized stream of working fluid and a surface of the component when the working fluid experiences shear forces;
g) maintaining the abrasive particles in suspension in the working fluid; and
h) providing relative motion between the holder and the nozzle with a motion system providing a material removal rate from a surface of the component.

2. The method according to claim 1, wherein step f) includes providing a dilatant additive to the working fluid for increasing the viscosity of the working fluid.

3. The method according to claim 1, wherein step g) includes providing a suspension agent to the working fluid for maintaining the abrasive particles suspended in the working fluid.

4. The method according to claim 1, wherein step g) comprising stirring the working fluid to maintain the abrasive particles in the working fluid suspension, thereby optimizing the removal rate and surface roughness.

5. The method according to claim 1, wherein the abrasive particles have a specific gravity greater than 5.

6. The method according to claim 1, further comprising i) recirculating the working fluid from the chamber back to the nozzle with a recirculation system.

7. The method according to claim 6, wherein the recirculation system comprises a pump for re-pressurizing the working fluid; and pipes for directing the working fluid between the chamber and the pump, and between the pump and the chamber.

8. The method according to claim 6, wherein step i) further comprises adjusting the temperature of the working fluid during recirculation for controlling the removal rate of particulate matter from the component with a temperature controller.

9. The method according to claim 8, wherein the temperature controller comprises a temperature sensor for determining the temperature of the working fluid; and a heating/cooling means for adjusting the temperature of the working fluid.

10. The method according to claim 1, wherein step h) includes reciprocating the nozzle back and forth over the component, whereby the nozzle dwells over different areas of the component based on predetermined desired characteristics using a computerized controller.

11. The method according to claim 10, wherein step h) further comprises determining characteristics of the component during particulate matter removal with sensors for comparing current characteristics to the predetermined desired characteristics.

12. The method according to claim 1, wherein step e) includes holding the nozzle perpendicular to the component for providing an annular profile of particulate matter removal.

13. The method according to claim 1, wherein step e) includes holding the nozzle at an acute angle to a line vertical to the component providing a teardrop shaped profile of particulate matter removal.

14. The method according to claim 1, further comprising adding air into the working fluid with an air injector for increasing the removal rate and surface roughness of the component.

15. The method according to claim 1, further comprising removing air bubbles that are present in the system via an air pocket.

16. The method according to claim 1, further comprising changing the pressure of the working fluid for altering the removal rate and surface roughness of the component.

17. The method according to claim 1, further comprising adjusting an opening of the nozzle for adjusting the removal rate and resolution of removal.

18. The method according to claim 1, further comprising adjusting a height of the nozzle above the component, thereby adjusting the removal rate and surface roughness of the component.

19. The method according to claim 1, further comprising directing a pressurized stream of working fluid at another surface of the component with an additional nozzle and an additional motion system.

20. The method according to claim 6, further comprising adjusting the pH of the working fluid during re-circulation for controlling the removal rate of particulate matter from the component.

* * * * *